US005181330A

United States Patent [19]

Schoch

[11] Patent Number: 5,181,330

[45] Date of Patent: Jan. 26, 1993

[54] DEVICE FOR ASSEMBLING SUPERPOSED, GLUED WEB-LIKE LAYERS

[75] Inventor: Gregor Schoch, Morges, Switzerland

[73] Assignee: Bobst SA, Switzerland

[21] Appl. No.: 790,592

[22] Filed: Nov. 8, 1991

[30] Foreign Application Priority Data

Nov. 14, 1990 [CH] Switzerland ..... 03617/90

[51] Int. Cl.[5] ..... F26B 13/06

[52] U.S. Cl. ..... 34/162; 34/41; 34/18; 34/4; 34/1 R; 34/155; 156/379.9; 156/272.2

[58] Field of Search ..... 34/155, 162, 203, 205, 34/216, 217, 236, 18, 4, 1 R, 1 A, 1 U, 1 V, 1 W, 1 X, 1 Y, 1 P, 41, 68; 156/470, 472, 205, 208, 210, 379.9, 272.2

[56] References Cited

U.S. PATENT DOCUMENTS

| | | | |
|---|---|---|---|
| 1,504,218 | 8/1924 | Crowell . | |
| 2,039,750 | 5/1936 | Swift, Jr. | 154/30 |
| 2,236,056 | 3/1941 | Grimm | 34/155 |
| 3,217,425 | 11/1965 | Nikkel | 34/49 |
| 3,319,353 | 5/1967 | Matsunami et al. | 34/155 |
| 3,368,933 | 2/1968 | Wicker | 34/162 |
| 4,169,007 | 9/1979 | Pray | 156/380 |
| 4,202,723 | 5/1980 | Chaudhuri | 156/470 |
| 4,419,173 | 12/1983 | Akiyama et al. | 34/155 |
| 4,556,444 | 12/1985 | Schommler | 34/162 |

FOREIGN PATENT DOCUMENTS

| | | |
|---|---|---|
| 904159 | 7/1972 | Canada . |
| 0077186 | 10/1984 | European Pat. Off. . |
| 1401830 | 4/1965 | France . |
| 1086199 | 10/1967 | United Kingdom . |
| 1238259 | 7/1971 | United Kingdom . |

*Primary Examiner*—Henry A. Bennet
*Assistant Examiner*—Denise L. F. Gromada
*Attorney, Agent, or Firm*—Hill, Steadman & Simpson

[57] ABSTRACT

A device, which assembles web-like workpieces consisting of superimposed glued layers to form a web of corrugated board material, includes three sections with a first section having a single heating plate and an upper blowing case, a second section including upper and lower transverse nozzles, as well as upper and lower suction chambers and a third section including the extension of the upper and lower suction chambers. The device includes a conveying arrangement which has an upper continuous mesh belt passing through the first, second and third sections, and a lower belt passing only through the second and third sections.

9 Claims, 2 Drawing Sheets

DEVICE FOR ASSEMBLING SUPERPOSED, GLUED WEB-LIKE LAYERS

BACKGROUND OF THE INVENTION

The present invention is directed to an assembling device for web-like workpieces consisting of superposed and glued layers. The device is used as a double-facer of a machine producing corrugated board and on which the layers continuously run in the form of a web.

For an appropriate presentation the invention will be described particularly in relation with a so-called double-facer.

As a rule, corrugated board is composed of a first so-called single-faced board layer consisting of fluted paper glued on a flat liner paper. This first layer is then assembled also by gluing with a second layer, which second layer may be either a second flat outer liner paper so as to form a so-called double-faced corrugated board or the second layer may be a second single-faced board to which an added outer liner paper is also applied so as to form a so-called double wall corrugated board. Corrugated boards with triple fluting is also produced in a similar way. A machine, which produces the corrugated board and is also called a corrugator, usually comprises a first so-called wet end in which the board is actually made and a second so-called dry end in which the web-like board is cut into individual sheets which are then piled up.

The first so-called wet end begins with a station, which is generally called a single-facer in the industry. In this station, the paper to be fluted after previously heating up and moistening runs through between two corrugating rolls themselves heated with steam. The flutes are shaped and held against the lower corrugating roll due to the action of either fingers or with regard to the cylinder outer means with which provides an overpressure or inner means in which a low pressure or vacuum is applied. An adjacent gluing drum applies glue on the tips of the flutes and then a preheated liner sheet is applied under pressure and with heat input against the tips by a pressing drum which is adjacent to the gluing drum and which pressing drum is also heated with steam. The glue will them immediately adhere owing to the effect of pressure and heat input.

The single-face corrugated board which is thus shaped then runs into a so-called glue unit which applies glue on the outer tips of the flutes which are still exposed. About one third of the water content in the glue amalgamates with the solid matter to form an adhesive whereas the remaining two thirds is freely available water which increases the paper moisture at this stage.

The single-face board thus provided with glue then runs on into a so-called double facer where it is joined with a second liner paper or else with the second single-faced intermediary board itself which is joined with a liner. The purpose of this double-facer is thus to put and hold together the various layers by simultaneously providing the necessary heat for the gelling of the glue and the removal of the moisture, to carry the amalgamated board forward, while continuing the elimination of moisture, and to hold the board flat throughout the cool-down process.

Considering the presence of the flutes, it is easy to understand that it is not possible to apply high pressure in the double-facer between the board layers, which is different than the prior action in the single-facer. This pressure reduction requires less heat input and thus much more time to get the glue gelled. In other words, at this stage of manufacture, the board travels continuously in the form of a web and the longer setting time will require an increase in the length of the double-facer.

The double-facer consists generally of a heating section as well as a pulling or second section onto also called a cooling section.

In the heating or first section the various layers destined to make up the corrugated board are applied on a number of heating plates with the help of an upper belt traveling through the whole station. An application pressure is exerted by the pressure roller acting on the upper belt. Another way of subjecting the various layers to pressure consist in using blowing cases or plenums which are arranged above the lower path of the upper belt and exert a uniform pressure on the whole upper side of the belt and, thus, on the various layers of the corrugated board. As a rule, the first section has 18 to 24 heating plates arranged in three or four sub-assemblies with each plate which extends perpendicular to the travel line of the corrugated board being produced. The plates have a lengthwise dimension slightly greater than the usable width of the corrugator and thus a width of about 50 cm. The plates are steam heated for each assembly.

A subsequent pulling section includes a lower drive belt which is driven synchronously with the upper belt. The corrugated boards are held between the two belts in order to be pulled out by the friction from the heating section.

The major draw back of such a double-facer is its considerable length. In fact, the production speed wanted determines not only the number of heating places required for the heat transfer into the corrugated board in order to cause the glue to gel and the water surplus contained in the corrugated board to be removed but also the length of the pulling section on account of the frictional forces involved. Similarly, the mechanical power required for the drive of the belt also becomes very significant. In addition, impurities, which are accumulating gradually in the joining areas between the plates, can reach such a point that they will scratch the lower liner of the corrugated board. This is all the more undesirable if the liner has undergone an embellishment treatment such as a coating or printing.

Finally, if it appears appropriate to use blowing cases or plenums in the heating section, the upper belt should almost certainly consist of a felt in order to insure sufficient friction between the upper belt and the corrugated web. In fact, a mesh belt has the advantage of letting water-laden air through the belt to provide uniformly applied pressures on the corrugated web; however, it does not build up any force of adherence between the belt and the corrugated board that would be sufficient for ensuring traction. However, such a force of adhesion or traction is generally useful for pulling the corrugated board through the device. On conventional devices, the considerable length of the successive heating plates entails a friction-type braking force to such an amount that all forces of adherence or traction appearing between the upper and lower belts and between the upper belt and the corrugated board will be necessary for transportation. A decease of the force of adherence between the upper belt and the corrugated board in the area of the blowing cases, which decrease would result from the use of a mesh belt, is thus inadmissable. On the other hand, the felt belt has the serious drawback of gathering moisture instead of letting it pass. So if so-called heavy corrugated boards are to be produced, the accumulation of moisture is likely to jeopardize production speed.

U.S. Pat. No. 3,217,425, a double-facer is proposed as an assembling device which does not use heating plates but comprises a lower belt acting together with supporting rollers and an upper belt running under the pressure rollers as well as under the upper nozzles, which are blowing hot air onto the corrugated board being produced. The air is immediately sucked into the lower pressure case. However, considering the excessive heating and drying performance of the device, the corrugated board has a tendency to warp quickly at the outlet depending on the excessive and insufficient moisture of the single-face board and/or of the various layers at the inlet. It is, thus, foreseen to put into operation a complex device for measuring the amount of warping at the outlet and providing a control for the preheating means, which act individually on each layer at the inlet. Nonetheless, the stabilization of this loop due to the counter-reaction is rather difficult to achieve and includes the secondary risk of overheating the glue prior to the layers being assembled.

SUMMARY OF THE INVENTION

The object of the present invention is to provide a double-facer, which ensues only that the layers are put into and held in firm contact with one another without any crushing but also ensues that the heating and drying of the corrugated board is properly regulated to ensure the setting of the glue as well as sufficient cooling so that the corrugated board will run out flat both lengthwise and crosswise. Because of the flatness of the surface condition of the lower paper liner, i.e. the outer liner on the package made of the corrugated board, the assembling device according to the present invention also ensures a better performance than the devices of the prior art.

To accomplish these goals, the present invention is directed to a device for assembling a web-like workpiece consisting of superimposed and glued layers and which device is designed for being used as a double-facer for producing corrugated board on which the layers continuously run in the form of a web. The device includes along a line for the traveling direction of the web a first so-called heating section followed by a second drying and pulling section followed by a third cooling and driving section, conveying means including an upper belt having an inlet drum and an outlet drum with the inlet drum being arranged adjacent to an inlet to the first section and the outlet drum being arranged adjacent the end of the third cooling and driving section, a lower belt extending around an inlet drum situated between the heating section and the beginning of the second drying and pulling section and an outlet drum arranged at the outlet of the cooling and driving section, wherein the upper belt and the lower belt are mesh belts. The first heating section consists essentially of a single heating plate provided with a smooth horizontal surface and a first blowing case positioned above the upper belt for directing a pulsating air through the upper belt downward on the heating plate, said second drying and pulling section including a row of upper slot shaped parallel extending nozzles in an upper suction case disposed above the upper surface of a lower run of the upper belt and having plurality of transverse pressure rollers disposed between adjacent nozzles engaging the belt surface, and a plurality of supporting rollers positioned under the run of the lower belt to support the lower belt in a plane, and the third cooling and driving section comprising extension of the upper suction case from the second to the third section and including a plurality of pressure rollers acting on the upper belt and supporting rollers supporting the run of the lower belt. Preferably, the second section also includes a row of lower slot shaped transverse nozzles situated underneath and extending perpendicular to the track of the corrugated board for blowing hot air through the lower belt onto the assembly of layers, and a suction box being applied around the lower nozzles and extending into the third section.

The above structure allows diminishing the length of the friction surface of the heating section and, hence, the force of friction in the heating section. Numerous practical tests undertaken in this field have shown that the heating plate with the length of one to two meters in the running direction would be sufficient to ensure proper setting of the glue as well as a plane surface of the outer liner. The reduction of friction due to the reduction of length provides either a reduction in the connected power for a given yield or an unchange length and connected power with a higher yield.

Moreover, the relatively small length of the heating plate in comparison with the length of the driving section allows the use of the mesh belt which as known from the prior art enables improve removal of moisture and thereby the discarding of the production speed limit which is due to the accumulation of moisture in the belt if the latter consist of felt.

Other advantages and features of the invention should be really apparent from the following description of the preferred embodiment, the drawings and claims.

DESCRIPTION OF THE PREFERRED EMBODIMENTS

Figure 1:
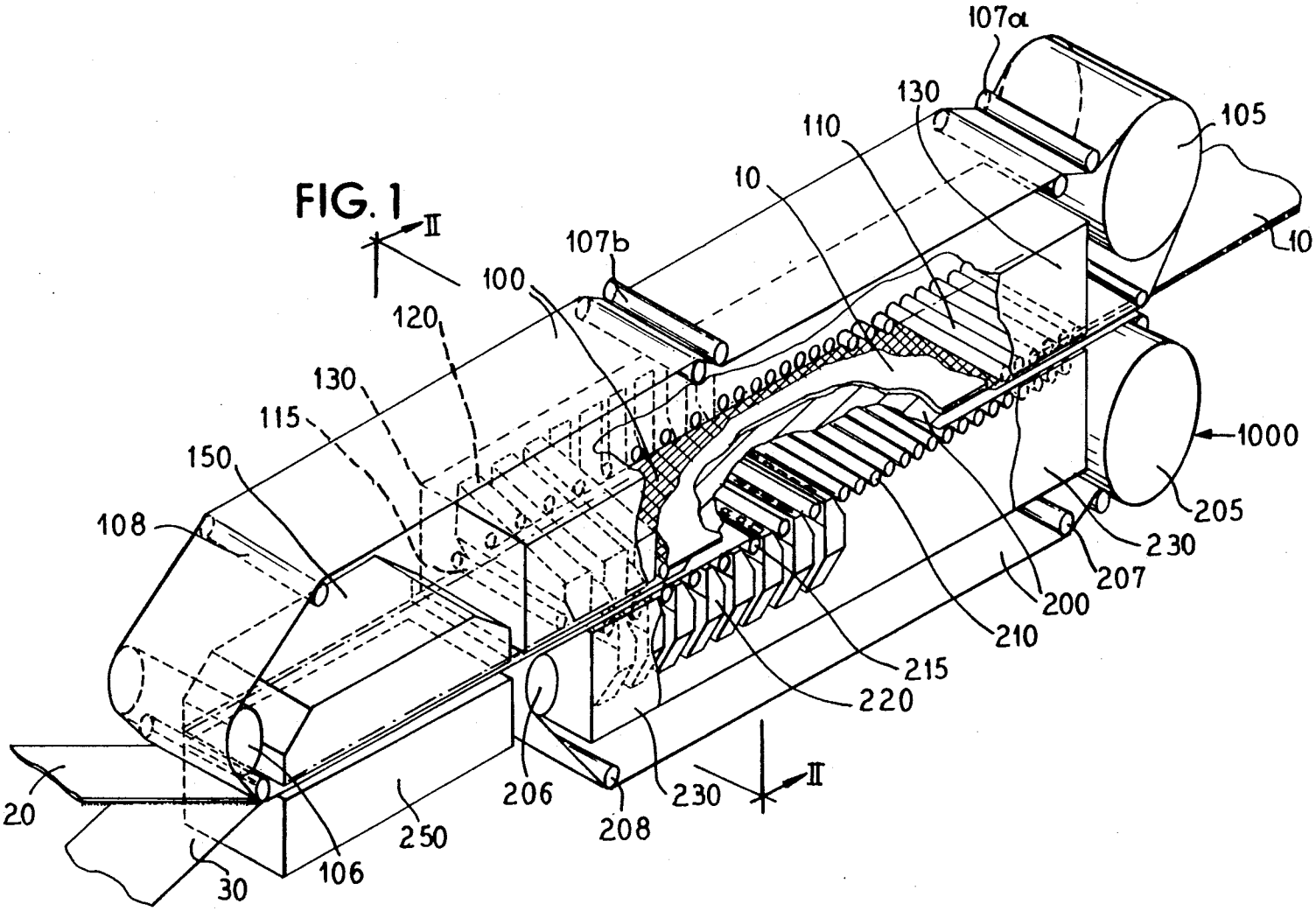
FIG. 1 is a schematic perspective view of this device according to the present invention with portions broken away for purposes of illustration.

The principles of the present invention are particularly useful when incorporated in an assembly device generally indicated 1000 in FIG. 1. The assembly device 1000 assembles a so-called single-faced layer 20, which has flutes extending therefrom with a so-called liner 30 to form a web 10 of corrugated board.

The assembling device 1000 as illustrated in FIG. 1 includes three successive though considerably distinct sections. The first of these sections is a so-called heating section which enables a gelling of the glue previously applied on the tips of the flutes of the upper or so-called single-face layer 20 which is destined to be assembled with the lower so-called liner layer 30 as the two layers 20 and 30 travel through in the form of webs. A second section is a so-called drying and pulling section which enables the extraction of the residue moisture from the two layers 20 and 30. This section contributes also at least partially to the conveyance of the corrugated board web 10 being produced. The third section is a so-called driving and cooling section which acts on the two assembled layers 20 and 30 in the form of the corrugated board web 10 which is being produced.

The first section consists essentially of a lower single horizontal plate 250 which is situated beneath the track of the webs 20 and 30 and includes an upper blow casing 150 which is positioned above the two webs 20 and 30 and also the heating plate 250. The heating plate 250 can be a cast or steel case which is fed with steam. Its crosswise dimensions is slightly larger than the useable width of the corrugator and has a width of about 2 meters. To avoid any deformation, the plate has an inner reinforcement with the form of ribs or braces acting as protuberances which will increase the heat exchange between the plate and the steam in the case. The upper surface of this plate is a perfect plane to allow the avoidance of any accumulations of impurities which would be likely to scratch the surface of the lower liner 30. Machining and fitting of this single heating plate are possible due to its dimensions. The purpose of the upper blowing case 150 is to blow air downward onto the upper side of the single face layer 20 in order to fully flatten the two layers 20 and 30 on the heating plate 250 to form the corrugated board 10.

As shown in FIG. 1, the second section which is a drying and pulling section comprises a row of upper identical nozzles 120 which are arranged to extend crosswise or transverse to the traveling direction of the layer 20 and 30 through the device 1000. The nozzles 120 extend over at least the whole useable width of the corrugator and are arranged to extend parallel to one another and sequentially in the running direction. Preferably, the drying section should comprise a row of lower nozzles 220 which are symmetrically arranged in correspondence with the upper nozzles 120. All the nozzles 120 and 220 have a common oblique parallelepipedic shape which means that if the upper nozzle 120 are considered, they are higher at the end from which the air arrives so that the cross-section decreases as the distance from the air source for the nozzle increases. The lower base of the upper nozzles 120 have a truncated shape arranged downwardly which on account of the ensuing decremental air blowing section, will engender a slight speed increment to the out flowing air. The upper nozzles 120 are located in an upper suction case 130 whereas the lower nozzles 220 are located in a lower suction case 230.

Figure 2:
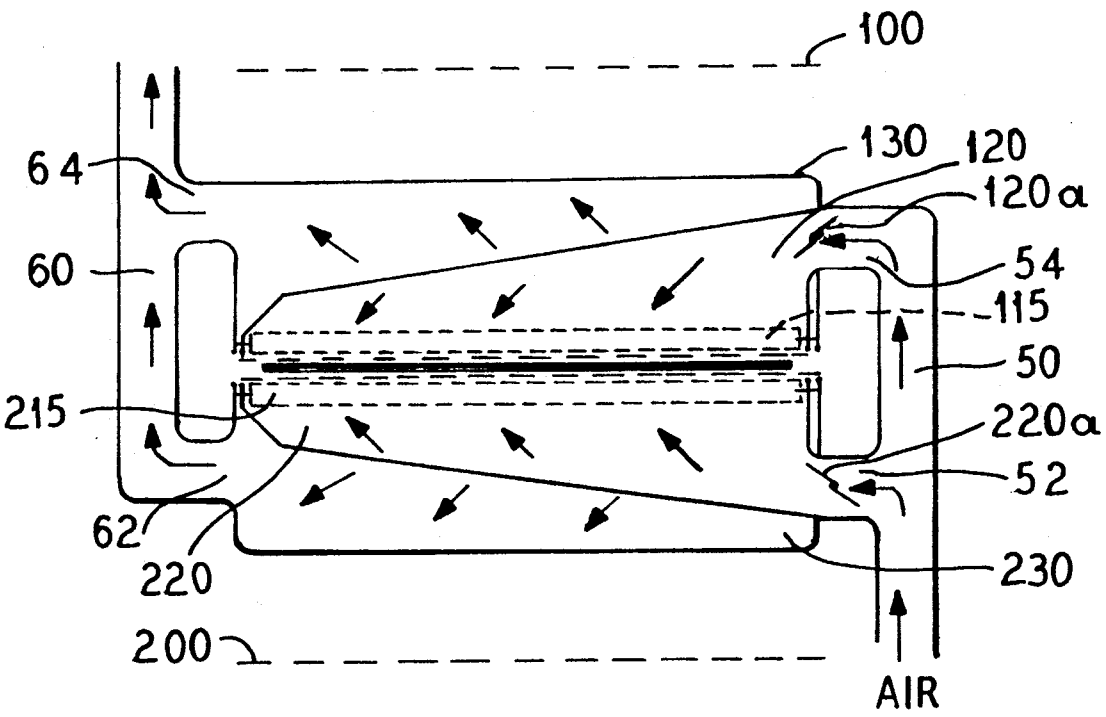
FIG. 2 is a cross-sectional view taken along plane II—II of FIG. 1.

As illustrated in FIG. 2, the air supplied to the nozzles 120 and 220 is from a source including a duct 50 which is connected by a number of supply pipes 52 to the lower corresponding nozzles 220 and by a number of upper supply pipes 54 to the upper nozzles 120. The hot air is thus blown down against the upper surface of the single-face layer 20 and upwardly against the lower surface of the liner layer 30 before being sucked upward by the upper casing 130 and downward by the lower casing 230. The two cases 130 and 230 are provided with ducts 62 and 64, respectively, which are connected to an outlet 60 which extends to a single pump (not shown) for creating a sufficient low pressure or vacuum within each of the cases 130 and 230.

As illustrated in FIG. 1, it will become obviously that the upper casing 130 extends towards the right-hand side, i.e. down stream beyond the row of upper nozzles 120 and this extension makes the upper part of the third so-called driving and cooling section. Similarly, the lower casing 230 also extends towards the right-hand side beyond the row of lower nozzles 220. The inner side of the straight part of the cases 130 and 230 have also low pressure due to the action of the outlet suction pump, so that fresh air will stream through the horizontal slots subsisting at the level of the board 10 between the two cases before escaping through the duct 60.

The section also includes a plurality of upper pressure rollers 115 which extend parallel to the nozzles 120 and are positioned between these nozzles and a plurality of lower pressure rollers 215 which are supporting rollers and extend between the nozzles 220. The third section which is the driving and cooling section includes lower support rollers 210 and upper pressure rollers 110.

To convey the webs 20 and 30 and also the corrugated board through the device 1000, the device includes conveyor means which include an upper continuous belt 100 and a lower continuous belt 200.

As illustrated in FIG. 1, an inlet end to find by an inlet drum 106 is positioned adjacent the inlet of the blowing case 150. The upper belt 100 passing around the drum 106 and travels first between the blowing case 150 and the heating plate 250 and then into the second so-called drying section which has the upper nozzles 120 and also under the first pressure rollers 115 which are located between the upper nozzles 120 and arranged parallel to them. The upper belt 100 then proceeds to travel into the third so-called driving and cooling section which has additional pressure rollers 110, which extend parallel to each other and transverse to the direction of movement of the web. At the outlet of the third chamber the upper belt 100 passes around another drum 105, which can be the driving drum. In order to take up any stretching, a first upper stretching roll pair **107*a* is located adjacent to the drum 105 and in the path returning to the first inlet drum 106, the belt is supported by a second upper roll pair 107*b* situated mainly in the center of the device as well as an upper guide roller 108 which is positioned mainly above the blowing case 150**.

The lower belt 200 extends between an inlet drum 206 and a lower outlet drum 205. The inlet drum 206 is situated following the heating plate 250 so that the lower belt 200 only engages the webs 20 and 30 after they have passed through the first section. The belt 200 runs over the lower nozzles 220 and is supported above these nozzles by the rollers 215 of the second section and then passes into the third section where it is supported by the rollers 210. As it leaves the third section, it passes over the lower outlet drive drum 205, which is a driving drum, and is taken through a pair of lower tightening rolls 207 before being directed towards the front end of the device to pass over a guiding roll 208 which is positioned adjacent a beginning of the lower exhaust or suction casing 230.

In operation, the single-face layer 20 has passed through a so-called glue unit so that the flutes have been moistened with an adhesive and then with the liner paper or layer 30 is introduced into the first section where the blowing case 150 applies a force of air to the layer 20 and forces the layer 20 against the layer 30 and also the layer 30 against the heating plate 220 to cause the gelling and setting of the glue to form corrugated board 10. The assembled corrugated board 10 is still wet and is taken in an inlet of the second station between the upper belt 100, which is forced downwardly by the pressure of the roller 115 and then the rollers 110 while the lower belt 200 is held in place by the supporting rollers 215 and also the rollers 210 in the third station. Since the only frictional forces to be overcome are those which are generated in the first heating section, the useful pulling track length, which corresponds to the length of the upper side of the lower belt 200, can be reduced to a considerably lesser dimension than in comparison to the previously used devices.

Since the belts 100 and 200 have a mesh structure, the air blown from the nozzles passes easily therethrough. Thereby the air stream gets loaded with humidity and is immediately absorbed by the suction cases 130 and 230. Attention should be drawn to the fact that the useful suction area at the level of the corrugated board 10 comprises the spaces between the nozzles minus the contact portion of the rollers 115 and 210 which portions are aerodynamically rather insignificant.

In addition, the board 10 undergoes a drying process and a cooling down simultaneously in the third section and is reliably held flat between the two belts 100 and 200. The belts 100 and 200 are guided in this section by the rollers 110 and 210.

Considering the high drying power, which is ensured by the nozzles and the suction cases, it may be appropriate to use only one row of such nozzles, i.e. the upper ones or the lower ones. Similarly, it is also envisioned to arrange a regulating shutter valve 120*a* in the inlets 54 for each of the upper nozzles 120 and a regulating shutter valve 220*a* in the inlet 52 of each of the lower nozzles 220. By utilizing these shutters, which form valve means, it is possible to shut off some of the nozzles in certain instances as desired.

Numerous other modifications can be added to the device mentioned above without impairing the essential idea of the invention. For instance, infra-red radiation, ultra-violet radiation, microwave radiation or electron-beam radiation and combinations of these various systems can be substituted for the hot air used for heating and drying. The heating system thus allows a differential heating input crosswise to the web in order to cope with possible transverse moisture variations appearing in the form of streaks in the traveling direction of the various layers.

Although various minor modifications may be suggested by those versed in the art, it should be understood that I wish to embody within the scope of the patent granted hereon all such modifications as reasonably and properly come within the scope of my contribution to the art.

I claim:

1. An assembling device for assembling web-like workpieces consisting of superimposed and glued layers, with one of said layers having a fluted portion to form a web of corrugated board, said device comprising a first section for heating the two layers, a second section for drying and pulling the two layers followed by a third section for cooling and driving, and a conveying means for conveying the layers through the first, second and third sections, said first section consisting of a single heating plate having a smooth upper surface for engaging a surface of the layers as the conveying means conveys the layers through the section, said first section including a blowing case positioned above the smooth upper surface, said blowing case being connected to a source of pulsating air, which is directed by the blowing case onto the surface of the plate, said second section including an upper suction case extending the length of the upper section, a plurality of upper nozzles being disposed in the upper suction case and extending perpendicular to the direction of movement of the webs through said second section and a plurality of pressure rollers positioned between the blowing nozzles, which are arranged to direct air on a surface of the web passing through the second section, said third section including an extension of the upper suction case and including parallel extending transverse rollers, said conveying means including an upper continuous mesh belt, an inlet drum and an outlet drum being positioned with the inlet drum ahead of the blowing case of the first section and the outlet drum following the end of the upper suction case so that a portion of the belt passes between the plate and the blowing case of the first section, adjacent the nozzles and engaged by the pressure rollers of the second section and also by the pressure rollers of the third section, said conveying means including a lower continuous mesh belt passing around an inlet drum situated between the heating plate and the beginning of the second section and an outlet drum disposed at the end of the third section so that a path of the lower belt goes through the second section and third section with the web of the layers being imposed between the lower belt and the upper belt.

2. A device according to claim 1, which includes a lower suction case extending the length of the second section and into the third section, a plurality of lower slot-shaped transverse nozzles being disposed in the lower suction case to extend perpendicular to the direction of travel of the web through the device, a plurality of support rolls interposed between the lower suction nozzles for supporting the lower belt as it passes therethrough, said third section including a plurality of support rollers disposed in the lower suction case.

3. A device according to claim 2, which includes means for applying heat to the webs passing through the second section.

4. A device according to claim 3, wherein the means for applying heat includes air being projected through said nozzles being hot air.

5. A device according to claim 3, wherein the means for applying heat includes applying radiation selected from infra-red radiation, ultra-violet radiation, microwave radiation and electron beam radiation.

6. A device for assembling a pair of webs, with one of the pair of webs having flutes to form a web of corrugated board material, said device including conveyor means, a first heating section, a second section and a third section, said conveying means including an upper continuous mesh belt extending over an inlet drum and an outlet drum, said first section including a single heating plate being positioned with a planar upper surface facing the path of the upper belt and a blowing case positioned on the opposite side of the upper belt to direct pulsating air toward said upper surface, said second section being a drying and pulling section including an upper suction case extending the length of the second section and the third section, said upper suction case, in the second section, having a plurality of upper slot-shaped parallel extending nozzles arranged to extend perpendicular to the direction of movement of the belt through said section for directing air downward through the mesh belt, said conveying means including a lower continuous mesh belt extending over a lower inlet drum and a lower outlet drum, with the lower inlet drum being positioned at the beginning of the second section and the lower outlet drum being positioned at the end of the third section so that a portion of the lower belt moves with a portion of the upper belt through the second and third sections, a plurality of supporting rollers for holding the portion of the lower belt against the upper belt and a plurality of pressure rollers being disposed between the nozzles of the second section and being provided in the third section for urging the upper belt against the lower belt.

7. A device according to claim 6, wherein the second section and third section include a lower suction case for receiving the supporting rollers of said second and third sections, and includes a plurality of lower slot-shaped transverse nozzles arranged between the support rollers in the second section for directing air upward through the lower mesh belt onto the layers being passed therethrough.

8. A device according to claim 7, which includes means for supplying hot air to the upper and lower nozzles.

9. A device according to claim 8, wherein the means for supplying hot air includes valve means for selectively closing upper and lower nozzles as desired.

* * * * *